United States Patent [19]

Cole, Jr. et al.

[11] 4,272,340

[45] Jun. 9, 1981

[54] ELECTROWINNING OF LEAD FROM $H_2SiF_6$ SOLUTION

[75] Inventors: Ernest R. Cole, Jr., Newburg; Agnes Y. Lee; Danton L. Paulson, both of Rolla, all of Mo.

[73] Assignee: The United States of America as represented by the Secretary of the Interior, Washington, D.C.

[21] Appl. No.: 164,759

[22] Filed: Jun. 30, 1980

Related U.S. Application Data

[63] Continuation-in-part of Ser. No. 108,191, Dec. 27, 1979.

[51] Int. Cl.[3] ..... C25D 3/34

[52] U.S. Cl. ..... 204/114; 204/57

[58] Field of Search ..... 204/57, 96, 114

[56] References Cited

U.S. PATENT DOCUMENTS

| | | | |
|---|---|---|---|
| 4,098,658 | 7/1978 | Ginatta | 204/114 |
| 4,107,007 | 8/1978 | Gäumann | 204/114 |
| 4,124,461 | 11/1978 | Stauter | 204/114 |

*Primary Examiner*—R. L. Andrews

*Attorney, Agent, or Firm*—William S. Brown; Donald A. Gardiner

[57] ABSTRACT

Lead is electrowon from aqueous phosphorus-containing fluosilicic acid solution by deposition on a lead cathode, employing an anode comprising a titanium substrate and an electrodeposited lead oxide coating having a uniform, dense grain size and structure.

5 Claims, No Drawings

ELECTROWINNING OF LEAD FROM $H_2SiF_6$ SOLUTION

This application is a continuation-in-part of application Ser. No. 108,191, filed Dec. 27, 1979.

Electrolytic refining of lead bullion is conventionally accomplished by means of electrolytic cells employing the bullion as anodes, pure electrolytic lead as cathodes, and an aqueous solution of lead fluosilicate and free fluosilicic acid as electrolyte. However, lead is not recoverd commercially be electrowinning except in fused salt baths at elevated temperatures, i.e., at about 500° C. Such procedures, however, have disadvantages such as materials problems, lead emissions, etc., and an ambient or low temperature process is much to be preferred.

Electrowinning of lead from aqueous solution, such as fluosilicate solution, at ambient temperatures has not previously been feasible due to formation of large amounts of insoluble $PbO_2$ at the anode. It has now been found, however, in accordance with the process of the invention, that the problem of excessive formation of $PbO_2$ at the anode may be overcome by addition of phosphorus to the aqueous electrolyte, and use of $PbO_2$-coated titanium anodes of the type described in U.S. Pat. No. 4,159,231, the disclosure of which is hereby incorporated by reference. This enables efficient electrowinning of lead from aqueous fluosilicic acid solutions at ambient or slightly higher temperatures.

As discussed in the said patent, the anodes employed in the process of the present invention consist of a titanium substrate and an electrodeposited lead oxide coating having a uniform, dense grain size and structure obtained by superimposing alternating current onto direct current during the electrodeposition.

The electrolyte employed in the process of the invention comprises a solution of a lead compound in aqueous fluosilicic acid. Concentrations of the lead and $H_2SiF_6$ are not critical but will generally range from about 60 to 80 grams of lead and 80 to 100 grams of $H_2SiF_6$ per liter of electrolyte solution. The $H_2SiF_6$ solution may be prepared from reagent-grade $H_2SiF_6$ or from a waste material, e.g., waste acid generated during manufacture of phosphate fertilizer. The waste acid is particularly suited for use in the process of the invention since it already contains a sufficient amount of phosphorus to retard $PbO_2$ formation at the anodes. If reagent-grade $H_2SiF_6$ is used, about 0.75 to 3 gpl phosphorus, in the form of a phosphorus compound, must be added to prevent $PbO_2$ formation at the anodes. Addition of a leveling agent such as aloes, calcium lignin sulfate, or animal glue may also be desirable to promote formation of a smooth deposit of lead on the cathode.

The source of the phosphorus in the electrolyte solution may be any phosphorus compound having sufficient solubility to provide the required concentration of phosphorus. Phosphoric acid, i.e., $H_3PO_4$, has generally been found to give very good results as the source of phosphorus in the process of the invention. Concentration of the acid is not critical, provided it is sufficient, in the amount employed, to provide the required amount of phosphorus, i.e., about 0.75 to 3 gpl, preferably about 1.5 to 2.5 gpl, in the electrolyte solution. Other compounds of phosphorus are, however, also effective as sources of phosphorus in the invention. These include salts of phosphoric acid such as alkali metal, alkaline earth metal or ammonium phosphates, or acid phosphates; organic phosphorus compounds; and phosphorus oxides.

The lead compound may be any compound having sufficient solubility in the $H_2SiF_6$ solution, e.g., $PbCO_3$, $Pb(OH)_2$ or PbO. The process of the invention has been found to be particularly effective for recovery of lead from scrap batteries. Battery sludge, containing oxides and sulfates of lead, is separated from the batteries by conventional means and the lead contained in the sludge is converted to a form that is soluble in fluosilicic acid. This is conveniently accomplished by means of a two-step process in which the sludge is initially reacted with a solution of ammonium carbonate to convert $PbSO_4$ to $H_2SiF_6$-soluble $PbCO_3$, and subsequently with lead powder and fluosilicic acid to solubilize $PbCO_3$ and $PbO_2$.

Although the electrowinning process of the invention has been found to be particularly effective for recovery of lead from scrap batteries, it can also be used to recover lead from any source in which the lead can be made soluble in fluosilicic acid. For example, lead chloride or lead sulfate, the latter generally being derived from lead sulfide ores that have been subjected to a low-temperature roast whereby the sulfide is converted to sulfate. Both the chloride and sulfate of lead are converted to lead carbonate by reaction with ammonium carbonate solution.

The electrolytic cell employed in the process of the invention is conventional and consists of plastic, such as polyethylene, or other material capable of withstanding the corrosive effects of the electrolyte. For commercial applications, electrolytic tanks or boxes of concrete lined with a plastic material or asphalt are generally employed. The cathodes consist of essentially pure lead, generally being prepared from electrowon cathode product. Both cathodes and anodes are generally employed in the form of plates or sheets, with optimum size, number, and spacing depending on the specific application of the process. Electrical power is supplied by means of conventional direct current power supplies, usually via copper bus bars. Suitable operating temperatures of the process of the invention will range from about 25° to 40° C., with ambient temperatures and pressures usually being satisfactory. Optimum current densities and time required for essentially complete deposition of lead from the electrolyte solution will also obviously depend on the specific application of the process and are best determined experimentally.

The process of the invention will be more specifically illustrated by the following examples.

EXAMPLE 1

An electrolyte solution containing 70 gpl Pb, 90 gpl free $H_2SiF_6$, 0.6 gpl aloes, 4.0 gpl calcium lignin sulfonate, and approximately 2 gpl phosphorus was prepared as follows: 100 g of battery sludge containing $PbSO_4$ and $PbO_2$ was reacted with 300 ml of an aqueous solution of ammonium carbonate containing 30 g of $(NH_4)_2CO_3$ to convert the $PbSO_4$ to $PbCO_3$, the reaction being carried out in a closed system under 26 psi pressure and at a temperature of about 50° C. for a period of 1 hour. The resulting mixture was filtered and the residue reacted with 450 ml of waste fluosilicic acid solution, containing 137 g $H_2SiF_6$, and 14.5 g of 200-mesh lead powder at about 50° C. for a period of 1 hour to dissolve $PbCO_3$ and $PbO_2$, and form a solution of $PbSiF_6$ and free $H_2SiF_6$. The required amounts of aloes and calcium lignin sulfonate were then added, as well as sufficient water to form 1 liter of electrolyte solution.

The electrolyte solution was placed in a 1-liter polyethylene plastic cell fitted with a pair of $PbO_2$-coated titanium anodes, in sheet form, prepared as described in the above-mentioned patent, and a single cathode of pure lead sheet. A 0.3-cm thick teflon top was used to hold and space the electrodes and to retard solution evaporation. The cathode was centered in the cell, with the anodes 3 cm on each side, and parallel to, the cathode. A 40 volt-50 A DC power supply was used to supply power to the cell via a copper bus bar.

Electrolysis, at a current density of 180 $A/m^2$ and ambient temperature, was conducted for a period of 24 hours, resulting in deposition of 108 grams of lead at the cathode. This represents 69 percent of the lead in the electrolyte. Chemical purity of the lead deposited on the cathode was 99.99+ percent. The current efficiency was near 97 percent and excellent cathode deposits were obtained with an energy consumption of less than 0.7 kwhr/kg of lead electrowon. At the same time, only 1.1 grams of $PbO_2$ were deposited at the anodes.

EXAMPLE 2

In this example, conditions were the same as those of Example 1, except that reagent grade fluosilicic acid, containing no phosphorus, was used in place of the waste fluosilicic acid of Example 1. Electrolysis for a period of 6 hours resulted in deposition of 26 grams of lead at the cathode. This represents 18 percent of the lead in the electrolyte. At the same time, 25 grams of $PbO_2$ was deposited at the anode. It is thus evident, in comparing the results of this example with that of Example 1, that the presence of phosphorus in the electrolyte was essential, and was very effective in preventing deposition of $PbO_2$ at the nodes.

EXAMPLE 3

In this example, conditions were the same as those of Example 1, except that 2 gpl phosphorus, as orthophosphoric acid, were added to the electrolyte. Electrolysis for a period of 21 hours resulted in deposition of 90 grams of lead at the cathode. This represents 64 percent of the lead in the electrolyte. At the same time, only 1.06 grams of $PbO_2$ were deposited at the anode, again illustrating the effectiveness of phosphorus in preventing deposition of $PbO_2$ at the anodes.

EXAMPLE 4

In this example, conditions were the same as those of Example 3, except that electrolysis was for a period of 6 hours. This resulted in deposition of 25.7 grams of lead at the cathode, which represents 18 percent of the lead in the electrolyte. At the same time, 0.34 gram of $PbO_2$ was deposited at the anodes.

EXAMPLES 5–8

In these examples, conditions were the same as those of Examples 3 and 4, except that the phosphorus was supplied by salts of phosphoric acid, specifically $Na_3PO_4.12H_2O$, $(NH_4)_2HPO_4$, $CaH_4(PO_4)_2$ and $HaH_2PO_2.H_2O$. In each case an amount of the salt equivalent to 1.5 gpl phosphorus was added to one liter of electrolyte made with reagent grade fluosilicic acid.

In each case, electrolysis for a period of 6 hours resulted in deposition of approximately 25 grams of lead on the cathode at about 96 to 98 percent current efficiency. This represents 36 percent of the lead in the electrolyte. Amounts of $PbO_2$ deposited at the anodes were 0.43 gram, 0.72 gram, 0.36 gram and 0.57 gram, respectively.

EXAMPLES 9 and 10

In these examples, conditions were the same as those of Examples 3–8, except that the phosphorus was supplied by two organic phosphorus compounds, i.e., hydroxyethylidenediphosphonic acid and methylenephosphonic acid. An amount of the acid equivalent to 2.6 and 1.2 gpl of phosphorus, respectively, was added to one liter of electrolyte made with reagent grade fluosilicic acid.

In each case, electrolysis for a period of 6 hours resulted in deposition of 25 grams of lead on the cathode at 96 to 97 percent current efficiency. This again represents 36 percent of lead in the electrolyte. Amounts of $PbO_2$ deposited at the anodes were 0.39 gram and 0.64 gram, respectively.

EXAMPLE 11

In this example, conditions were the same as those of Examples 3–10, except that the phosphorus was supplied by $P_2O_5$ in an amount equivalent to 2 gpl phosphorus in 1 liter of electrolyte made with reagent grade fluosilicic acid.

Again, 25 grams of lead, representing 36 percent of the lead in the electrolyte, were deposited on the cathode at 97 percent current efficiency during a 6 hour period of electrolysis. At the same time, 0.42 gram of $PbO_2$ was deposited at the anodes.

It is apparent from the above results that each phosphorus compound was very effective in retarding $PbO_2$ formation at the anodes.

We claim:

1. A process for electrowinning of lead comprising:

(1) providing an electrolyte cell consisting essentially of at least one anode consisting essentially of a titanium substrate and an electrodeposited lead oxide coating having a uniform, dense grain size and structure, at least one cathode consisting essentially of lead, and an electrolyte comprising an aqueous solution of lead fluosilicate, free fluosilicic acid and a phosphorus compound in an amount sufficient to provide a concentration of phosphorus of about 0.75 to 3 gpl in the solution, and (2) establishing a direct current between anode and cathode to effect electrodeposition of lead on the cathodes.

2. The process of claim 1 in which the phosphorus compound is selected from the group consisting of a phosphoric acid, a salt of phosphoric acid, an organic phosphorus compound, and an oxide of phosphorus.

3. The process of claim 1 in which the anode is prepared by electrodeposition of the lead oxide coating by means of alternating current superimposed on direct current.

4. The process of claim 1 in which the electrolyte is prepared from the lead sulfate and oxide-containing battery sludge by means of a process comprising the steps of (a) reacting the sludge with an aqueous solution of ammonium carbonate to convert lead sulfate to carbonate, and (b) reacting the residue with phosphorus-containing fluosilicic acid solution and lead power to solubilize lead carbonate and lead oxide.

5. The process of claim 1 in which the electrodeposition is carried out at ambient temperature.

* * * * *